US007772784B2

(12) United States Patent
Yamasaki et al.

(10) Patent No.: US 7,772,784 B2
(45) Date of Patent: Aug. 10, 2010

(54) TRANSFORMER, ILLUMINATING APPARATUS USING THE SAME, AND DISPLAY APPARATUS USING THE SAME

(75) Inventors: Hitoshi Yamasaki, Osaka (JP); Sadao Morimoto, Hyogo (JP); Katsumi Matsumura, Hyogo (JP)

(73) Assignee: Panasonic Corporation, Osaka (JP)

( * ) Notice: Subject to any disclaimer, the term of this patent is extended or adjusted under 35 U.S.C. 154(b) by 555 days.

(21) Appl. No.: 11/720,565

(22) PCT Filed: Feb. 9, 2006

(86) PCT No.: PCT/JP2006/302681

§ 371 (c)(1),
(2), (4) Date: May 31, 2007

(87) PCT Pub. No.: WO2006/085683

PCT Pub. Date: Aug. 17, 2006

(65) Prior Publication Data

US 2009/0146577 A1 Jun. 11, 2009

(30) Foreign Application Priority Data

| | | |
|---|---|---|
| Feb. 9, 2005 | (JP) | 2005-032544 |
| Feb. 9, 2005 | (JP) | 2005032545 |
| Jul. 1, 2005 | (JP) | 2005-193374 |
| Jul. 1, 2005 | (JP) | 2005-193375 |

(51) Int. Cl.
*H05B 41/16* (2006.01)

(52) U.S. Cl. ..... 315/257; 315/291; 315/209 R

(58) Field of Classification Search ..... 123/149 D, 123/149 R, 406.56, 406.57, 595, 598, 599, 123/601, 604, 606, 618, 620, 621, 634, 637; 315/111.41, 111.81, 177, 209 CD, 209 R, 315/209 SC, 209 T, 218, 219, 223, 224, 227 R, 315/239, 240, 244, 247, 248, 254, 257, 276, 315/277, 278, 280, 282, 283, 284, 287, 290, 315/291, 307, 308, 324, 411, 51, 57, 58, 315/62, 70, 73, 82, 85, DIG. 4, DIG. 5, DIG. 7; 323/215, 222, 247, 248, 250, 251, 253, 254, 323/259, 261, 266, 272, 290, 307, 308, 331, 323/333, 334, 335, 362; 336/18, 266, 268, 336/110, 133, 145, 160, 155, 165, 170, 172, 336/173, 177, 178, 180, 182, 184, 198, 200, 336/205, 208, 212, 214, 215, 220, 221, 222, 336/223, 229, 233, 234, 30, 5, 65, 83; 363/126, 363/131, 132, 133, 134, 16, 17, 20, 21.04, 363/24, 39, 44, 46, 47, 55, 61, 68, 75, 97, 363/98

See application file for complete search history.

(56) References Cited

U.S. PATENT DOCUMENTS

| | | | | |
|---|---|---|---|---|
| 7,477,023 | B2 * | 1/2009 | Shimura et al. | 315/282 |
| 2005/0179393 | A1 * | 8/2005 | Murakami et al. | 315/77 |

FOREIGN PATENT DOCUMENTS

| | | |
|---|---|---|
| CN | 1298190 A | 6/2001 |
| CN | 2554891 Y | 6/2003 |
| JP | 56-034400 | 8/1981 |
| JP | 03-029917 | 6/1991 |
| JP | 2001-126937 | 5/2001 |
| JP | 2001-148318 | 5/2001 |
| JP | 2002-017090 | 1/2002 |
| JP | 2003-022917 | 1/2003 |
| JP | 2005-012176 | 1/2005 |
| JP | 2006-040871 | 2/2006 |

OTHER PUBLICATIONS

International Search Report for application No. PCT/JP2006/302681 dated May 23, 2006.

* cited by examiner

*Primary Examiner*—Douglas W Owens
*Assistant Examiner*—Jae K Kim
(74) *Attorney, Agent, or Firm*—RatnerPrestia

(57) ABSTRACT

A transformer arranged to be used for an illuminating apparatus includes a closed-magnetic-circuit core, a primary coil wounded around the closed-magnetic-circuit core, and multiple secondary coils wounded around the closed-magnetic-circuit core. The secondary coils include first ends and second ends. The illuminating apparatus includes multiple discharge lamps. Each of the first ends and each of the second ends of each secondary coil are connected to different discharge lamps.

22 Claims, 13 Drawing Sheets

TRANSFORMER, ILLUMINATING APPARATUS USING THE SAME, AND DISPLAY APPARATUS USING THE SAME

This application is a U.S. national phase application of PCT International Application PCT/JP2006/302681.

TECHNICAL FIELD

The present invention relates to a transformer for supplying a voltage to a discharge lamp and an illuminating apparatus and a display apparatus including this transformer.

BACKGROUND ART

FIGS. 11 and 12 are an exploded perspective view and a perspective view conventional transformer 5001 disclosed in Japanese Patent Laid-Open Publication No. 2003-22917, respectively. Transformer 5001 includes closed-magnetic-circuit core 1, primary bobbin 3 assembled with core 1, two secondary bobbins 5 assembled with core 1, primary coil 2 wounded in coil groove 8 of primary bobbin 3, secondary coils 4 wounded in coil grooves 8 of two secondary bobbins 5 a primary coil terminal embedded in primary bobbin 3 and connected to one end of primary coil 2, low potential terminals 6A and 6B embedded in secondary bobbin 5 and connected to one end of secondary coil 4, and high potential terminals 7A and 7B connected to another end of secondary coil 4.

Closed-magnetic-circuit core 1 includes rear magnetic legs 9A and 9B having flat shapes are facing each other, two inner magnetic legs 10, two outer magnetic leg 11A, and two outer magnetic legs 11B. Inner magnetic legs 10, outer magnetic leg 11A, and outer magnetic legs 11B are connected to two rear magnetic legs 9A and 9B between rear magnetic legs 9A and 9B. Outer magnetic leg 11A has a rectangular column shape. Outer magnetic legs 11B have cylindrical column shapes. Primary bobbin 3 is assembled with outer magnetic legs 11A. Secondary bobbins 5 are combined with outer magnetic legs 11B, respectively. A gap is provided between inner magnetic leg 10 and rear magnetic leg 9A.

A straight discharge lamp is connected to low potential terminal 6A connected to one end of secondary coil 4, and connected to high potential terminal 7A connected to another end of secondary coil 4. Another straight discharge lamp is connected to low potential terminal 6B connected to one end of another secondary coil 4, and is connected to high potential terminal 7B connected to another end of another secondary coil 4. Transformer 5001 illuminates the two straight discharge lamps and is used as an inverter transformer for a back light of a light-transmittable display device, such as a liquid crystal display.

The display device has a screen having a large size, accordingly requiring two or more straight discharge lamps as its back light. If respective lighting timings of these straight discharge lamps are different from each other, a brightness variation may be caused on the screen of the liquid crystal display using these straight discharge lamps.

In general, there is a variation in properties, such as impedance of the discharge lamps and a stray capacitance of peripheral components. If one of the discharge lamps is turned on first due to the variation of the properties, a voltage output from secondary coil 4 connected to another discharge lamp may be lowered to a value lower than a voltage of secondary coil 4 connected to the discharge lamp which is turned on first. Accordingly, another discharge lamp which is connected to another secondary coil 4 may not be turned or may be turned on late.

SUMMARY OF THE INVENTION

A transformer arranged to be used for an illuminating apparatus includes a closed-magnetic-circuit core, a primary coil wounded around the closed-magnetic-circuit core, and plural secondary coils wounded around the closed-magnetic-circuit core. The plural secondary coils include respective first ends and respective second ends. The illuminating apparatus includes plural discharge lamps. Each of the respective first ends and each of the respective second ends are arranged to be connected to discharge lamps, out of the plurality of discharge lamps, different from each other.

This transformer prevents variation of lighting timings of discharge lamps, accordingly providing an illuminating apparatus and a display apparatus having little brightness variation.

DETAIL DESCRIPTION OF THE PREFERRED EMBODIMENT

Figure 1A:
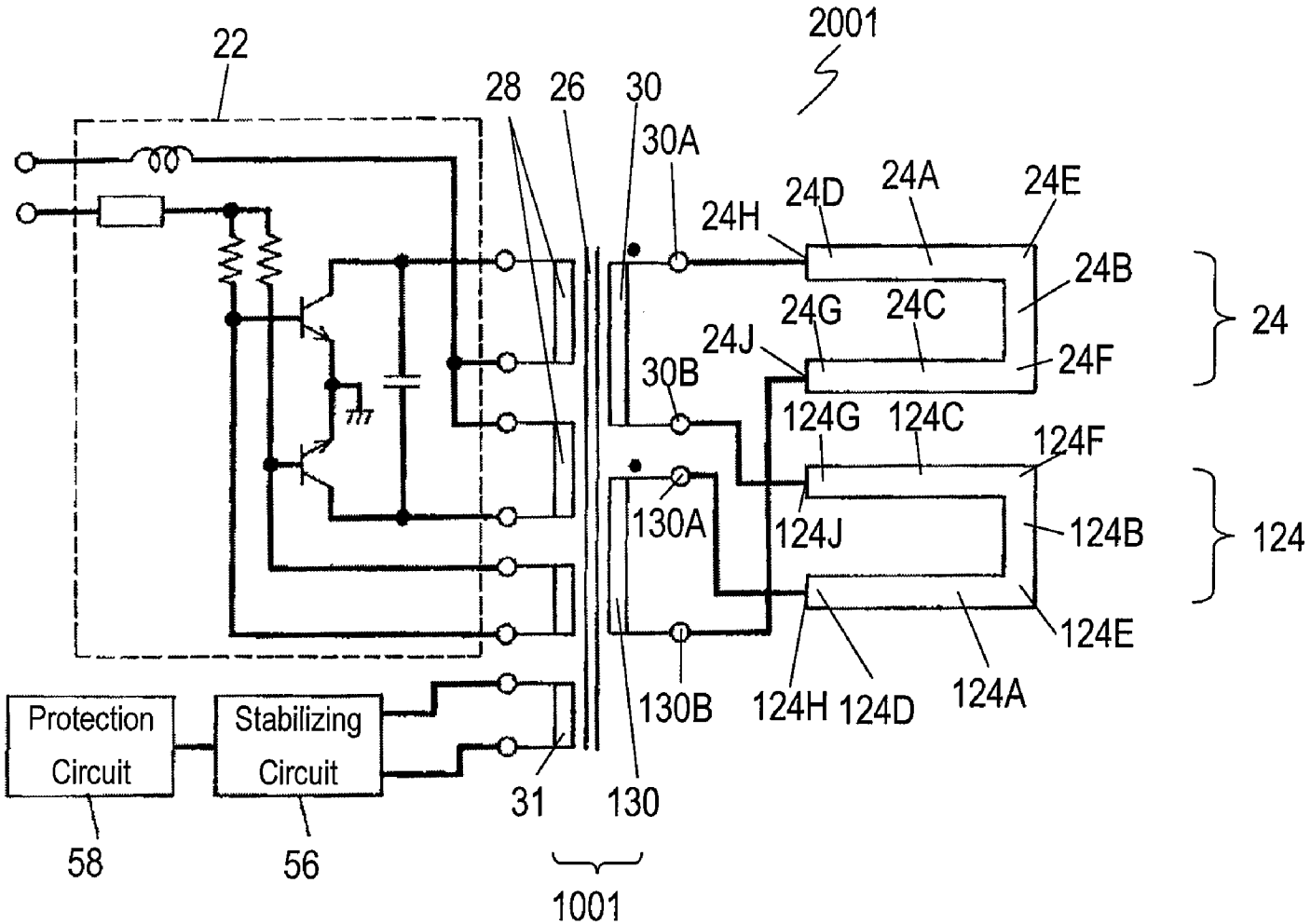
FIG. 1A is a circuit diagram of an illuminating apparatus including a transformer according to an exemplary embodiment of the present invention.
Figure 1B:
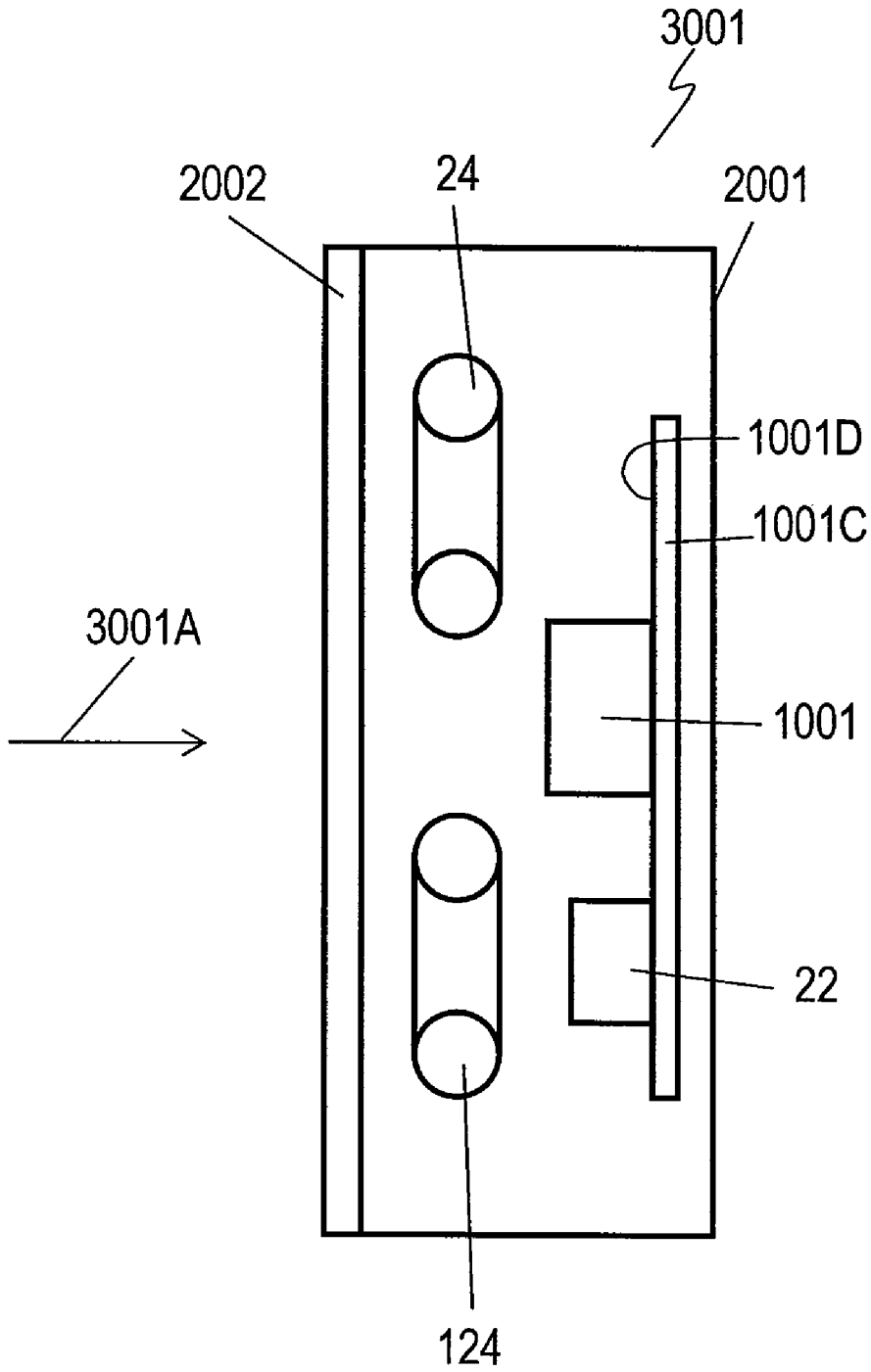
FIG. 1B is a cross sectional view of a display apparatus according to the embodiment.
Figure 2:
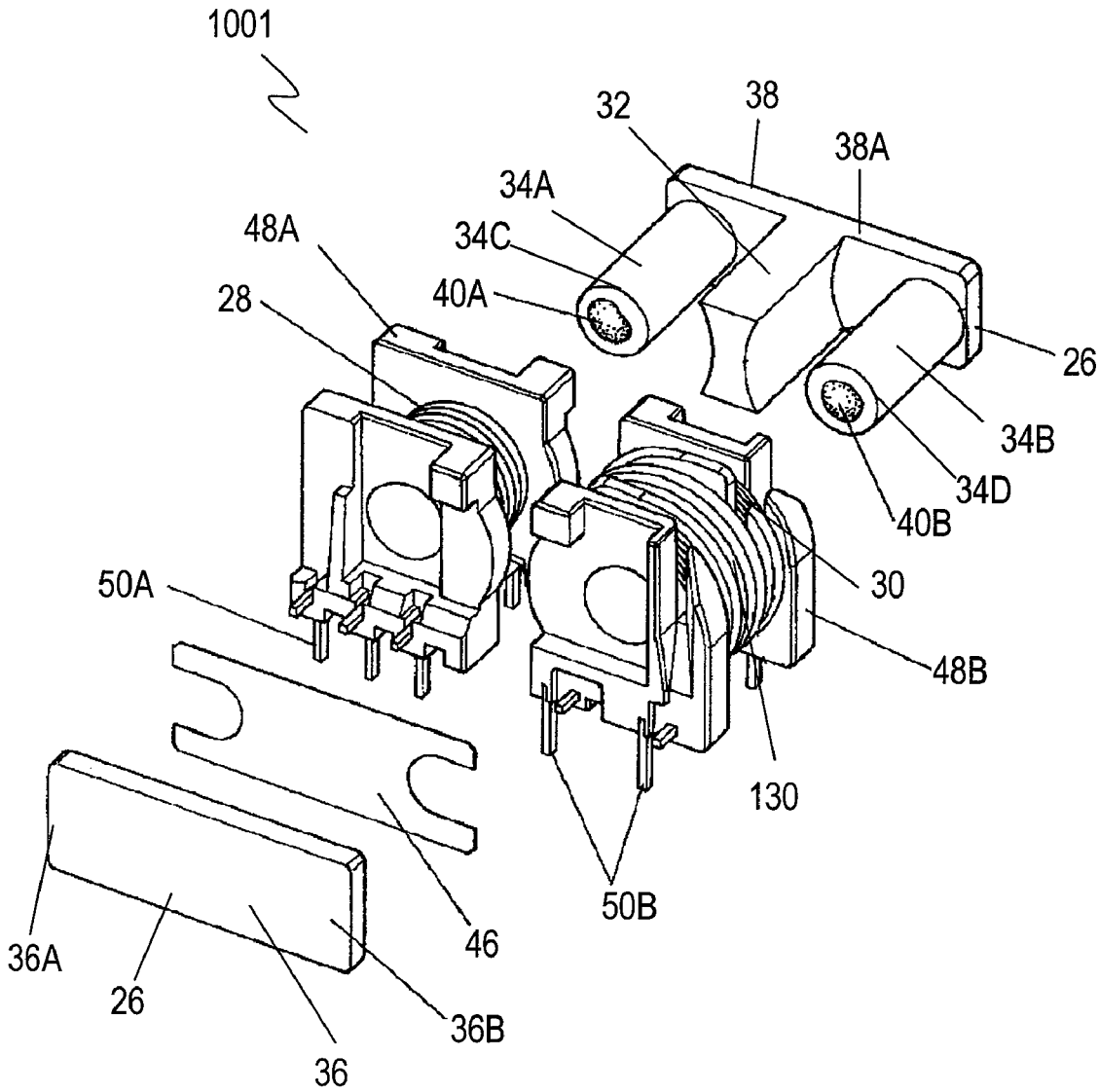
FIG. 2 is an exploded perspective view of the transformer according to the embodiment.
Figure 3:
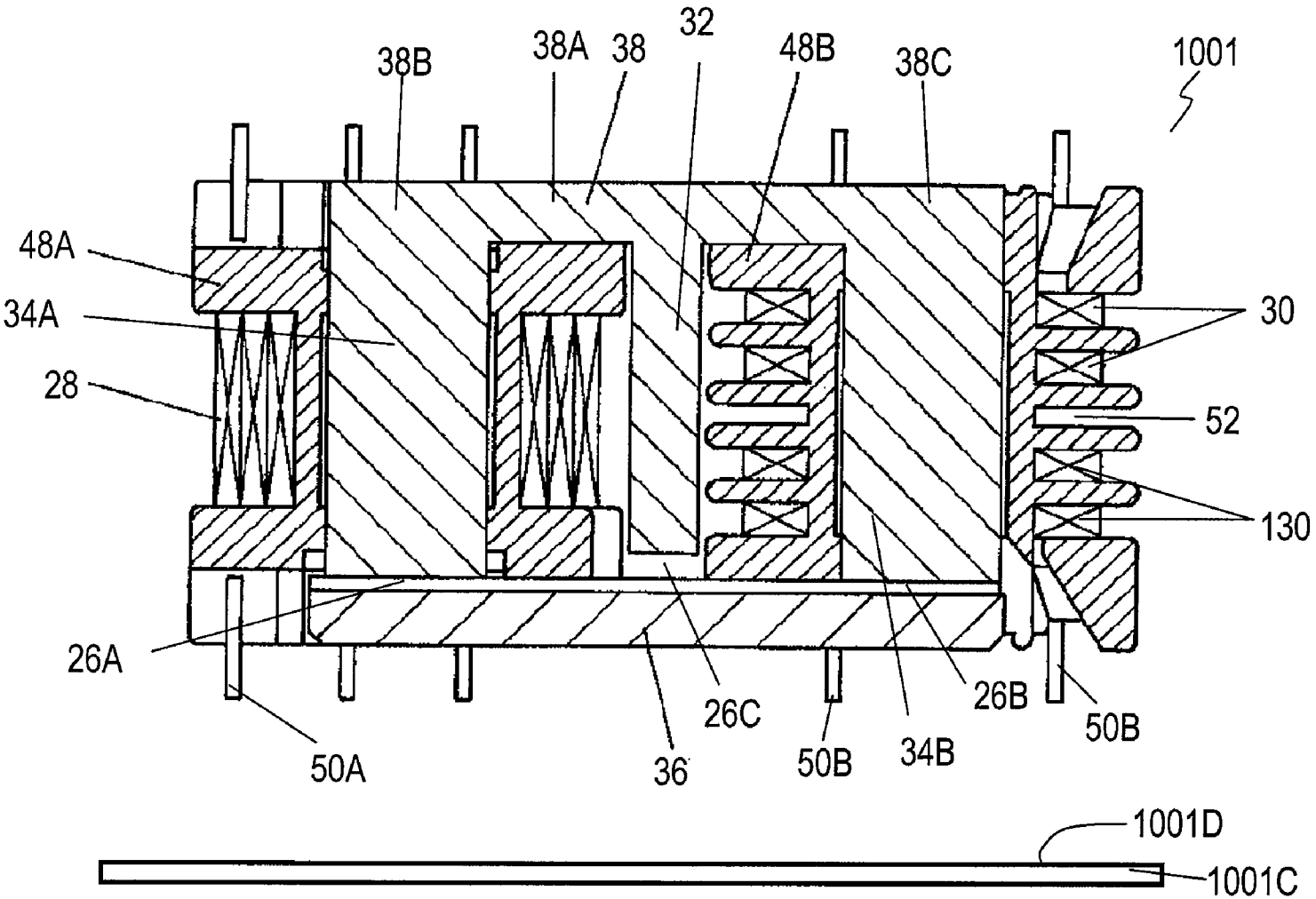
FIG. 3 is a cross sectional view of the transformer according to the embodiment.

FIG. 1A is a circuit diagram of illuminating apparatus 2001 including transformer 1001 according to an exemplary embodiment of the present invention. FIG. 1B is a cross sectional view of display apparatus 3001 according to the embodiment. FIGS. 2 and 3 are an exploded perspective view and a cross sectional view of transformer 1001, respectively.

As shown in FIG. 1A, illuminating apparatus 2001 includes U-shaped discharge lamps 24 and 124, transformer 1001 connected to U-shaped discharge lamps 24 and 124, and switching circuit 22 for applying an alternating-current (AC) voltage (a pulsating voltage) to transformer 1001. Transformer 1001 raises a voltage supplied from switching circuit 22 to a predetermined AC voltage, and supplies this voltage to U-shaped discharge lamps 24 and 124 as to turn on discharge lamps 24 and 124.

As shown in FIG. 1B, display apparatus 3001 includes illuminating apparatus 2001 and display device 2002, such as a liquid crystal display, which does not light by itself Light from U-shaped discharge lamps 24 and 124 of illuminating apparatus 2001 illuminates display device 2002 and is transmitted through display device 2002, hence allowing an operator to look at a screen of display device 2002 from direction 3001A. Illuminating apparatus 2001 functions as a back light of display device 2002. Transformer 1001 and switching circuit 22 are mounted on mounting surface 1001D of board 1001C.

In transformer 1001, primary coil 28, secondary coils 30 and 130, and tertiary coil 31 are wounded around closed-magnetic-circuit core 26. Secondary coil 30 as a first secondary coil has end 30A as a first end and end 30B as a second end. Secondary coil 130 as a second secondary coil has end 130A as a first en and end 130B as a secondary end. End 30A of secondary coil 30 and end 130A of secondary coil 130 have polarities identical to each other. When an AC voltage is applied to primary coil 28, end 30A of secondary coil 30 and end 130A of secondary coil 130 output AC voltages having phases identical to each other. End 30B of secondary coil 30 and end 130B of secondary coil 130 have polarities identical to each other. When an AC voltage is applied to primary coil 28, end 30B of secondary coil 30 and end 130B of secondary coil 130 output AC voltages having phase opposite to each other. In other words, end 30B of secondary coil 30 and end 130B of secondary coil 130 output AC voltages having phases identical to each other.

U-shaped discharge lamp 24 has bar portion 24B and bar portions 24A and 24C. Bar portions 24A and 24C are parallel to each other. Bar portion 24A has both ends, end portions 24D and 24E. Bar portion 24C has both ends, end portions 24F and 24G. Bar portion 24B is connected to end portion 24E of bar portion 24A and end portion 24F of bar portion 24C, thus providing discharge lamp 24 with the U-shape having two end portions 24D and 24G. Electrodes 24H and 24J are provided at end portions 24D and 24G, respectively. Similarly, U-shaped discharge lamp 124 has bar portion 124B and bar portions 124A and 124C. Bar portions 124A and 124C are parallel to each other. Bar portion 124A has both ends, end portions 124D and 124E. Bar portion 124C has both ends, end portions 124F and 124G. Bar portion 124B is connected to end portion 124E of bar portion 124A and end portion 124F of bar portion 124C, thus providing discharge lamp 124 with a U-shape having two end portions 124D and 124G. Electrodes 24H and 24J are provided at end portions 124D and 124G, respectively. U-shaped discharge lamps 24 and 124 are arranged so that bar portions 24A, 24C, 124A, and 124C are located in parallel to each other, and bar portions 24C and 124C are adjacent to each other. Accordingly, end portions 24G and 124G are adjacent to each other, and end portion 24D is away from end portion 124D.

End 30B of secondary coil 30 of transformer 1001 is connected to electrode 124J provided at end portion 124G of U-shaped discharge lamp 124. End 130B of secondary coil 130 is connected to electrode 124J provided at end portion 24G of U-shaped discharge lamp 24. End portions 24G and 124G are adjacent to each other, accordingly making electrode 24J adjacent to electrode 124J. That is, the AC voltages having the phases identical to each other is applied to electrodes 24J and 124J provided at end portions 24G and 124G adjacent to each other, respectively, thus providing electrodes 24J and 124J with polarities identical to each other.

Closed-magnetic-circuit core 26 of transformer 1001 is made of magnetic material, and includes I-shaped divided core 36 having an I-shape and E-shaped divided core 38 having an E-shape. E-shaped divided core 38 includes outer magnetic legs 34A and 34B, inner magnetic leg 32, and coupling portion 38A having a bar shape, which are unitarily formed. Outer magnetic legs 34A and 34B are connected to end portions 38B and 38C of coupling portion 38A, i.e. both ends of the bar shape of portion 38A, respectively, and extend perpendicularly to coupling portion 38A. Inner magnetic leg 32 is located between outer magnetic legs 34A and 34B and extends perpendicularly to coupling portion 38A from coupling portion 38A between outer magnetic legs 34A and 34B. Tips 34C and 34D of outer magnetic legs 34A and 34B of E-shaped divided core 38 are connected to end portions 36A and 36B of I-shaped divided core 36. I-shaped divided core 36 is located in parallel to mounting surface 1001D of board 1001C on which transformer 1001 is arranged to mount.

In closed-magnetic-circuit core 26, gaps 26A and 26B are provided between outer magnetic leg 34A of E-shaped divided core 38 and I-shaped divided core 36 and between outer magnetic leg 34B of E-shaped divided core 38 and I-shaped divided core 36, respectively. Gap 26C is provided between inner magnetic leg 32 and I-shaped divided core 36. Gaps 26A and 26B are produced with adhesive agent 40. Gap 26C is formed by gap paper sheet 46 sandwiched between inner magnetic leg 32 and I-shaped divided core 36.

Bobbin 48A is assembled around outer magnetic leg 34A of E-shaped divided core 38. Primary coil 28 is wounded around outer magnetic leg 34A. Bobbin 48B is assembled around outer magnetic leg 34B. Secondary coils 30 and 130 are wounded around outer magnetic leg 34B. An end of primary coil 28 is connected to terminal 50A embedded in bobbin 48A. Respective ands of secondary coils 30 and 130 are connected to terminal SOB embedded in bobbin 48B. Groove 52 is formed in a center portion of bobbin 48B between secondary coils 30 and 130. Secondary coils 30 and 130 are arranged side by side to position groove 52 between coils 30 and 130 to have no respective portions of coils 30 and 130 overlapping each other. Secondary coils 30 and 130 are wounded in directions opposite to each other. Ends 30A and 130A of secondary coils 30 and 130 have potentials substantially identical to each other.

Secondary coil 130 is closer to gap 26B than secondary coil 30 is. Much leakage magnetic flux is generated around gap 26B, accordingly decreasing magnetic flux crossing secondary coil 130 which is closer to gap 26B than secondary coil 30 is. In order to make a voltage appearing in secondary coil 130 equal to a voltage appearing in secondary coil 30, the number of turns of secondary coil 130 is greater than that of secondary coil 30.

End 30A of secondary coil 30 of transformer 1001 is connected to electrode 24H provided at end portion 24D of U-shaped discharge lamp 24. End 30B of secondary coil 30 is connected to electrode 124J provided at end portion 124G of U-shaped discharge lamp 124. End 130A of secondary coil 130 is connected to electrode 124H provided at end portion 124D of U-shaped discharge lamp 124. End 130B of secondary coil 130 is connected to electrode 24H provided at end portion 24D of U-shaped discharge lamp 24. That is, ends 30A and 30B of secondary coil 30 are connected to U-shaped discharge lamps 24 and 124 different from each other, respectively. Ends 130A and 130B of secondary coil 130 are connected to U-shaped discharge lamps 24 and 124 different from each other, respectively. In this constitution, secondary coils 30 and 130 and U-shaped discharge lamps 24 and 124 are connected in series to each other, respectively. Predetermined voltages are generated between ends 30A and 30B of secondary coil 30 and between ends 130A and 130B of secondary coil 130, and turn on both of U-shaped discharge lamps 24 and 124. If times when secondary coils 30 and 130 output the predetermined voltages deviate, U-shaped discharge lamps 24 and 124 are not turned on. This operation prevents failure or delay of turning-on of one of U-shaped discharge lamps 24 and 124 caused by other of U-shaped discharge lamps 24 and 124 turned on earlier. This operation prevents variation of timings of turning-on of U-shaped discharge lamps 24 and 124, accordingly reducing brightness variation of display device 2002, such as a liquid crystal display, transmitting light from discharge lamps 24 and 124 of illuminating apparatus 2001.

In transformer 1001, primary coil 28 is wounded around outer magnetic leg 34A, and secondary coils 30 and 130 are wounded around one outer magnetic leg 34B. Magnetic flux generated from primary coil 28 induces a voltage stably, and thus, allowing secondary coils 30 and 130 to output voltages stably identical to each other. This reduces variation of the voltages output from of secondary coils 30 and 130, and thus, prevents one of U-shaped discharge lamps 24 and 124 from being brighter than other of the lamps, accordingly reducing brightness variation of display device 2002.

Secondary coil 130 is closer to gap 26B of outer magnetic leg 34B than secondary coil 30 is. The number of turns of secondary coil 30 is greater than that of secondary coil 30. This structure reduces the difference between respective leakage magnetic fluxes generated from secondary coil 30 and secondary coil 130, accordingly reducing unevenness of the output voltages caused by the difference of the leakage magnetic fluxes.

Secondary coils 30 and 130 are arranged side by side around outer magnetic leg 34B, such that no portions of the coils overlap each other. Ends 30A and 130A of secondary coils 30 and 130 adjacent to each other have potentials substantially identical to each other. After ends 30A, 30B, 130A, and 130B of secondary coils 30 and 130 are connected to terminals 50B, ends of secondary coils 30 and 130 having potentials different from each other do not cross, thus preventing short-circuit between a portion of a low potential and a portion of a high potential of secondary coils 30 and 130.

Secondary coils 30 and 130 are wounded around single outer magnetic leg 34A. As shown in FIG. 1A, polarities of electrodes 24H and 24J at end portions 24D and 24G of U-shaped discharge lamp 24 are arranged in reverse from polarities of electrodes 124H and 124J at end portions 124D and 214G of U-shaped discharge lamp 124. This arrangement allows a voltage applied to end portion 24D of U-shaped discharge lamp 24 to have a waveform having the same phase as and a polarity opposite to a voltage applied to end portion 124G of U-shaped discharge lamp 124. Thereby, portions emitting light and portions emitting no light of U-shaped discharge lamp 24 and 124 are located substantially at constant positions. If a frequency of a voltage input from switching circuit 22 into primary coil 28 is sufficiently high, an operator cannot follow the switching between the light emission portion and no-light emission portion, thus not feeling flicker. Accordingly, display apparatus 3001 which is viewed with light from U-shaped discharge lamps 24 and 124 prevents flicker of a screen of display device 2002.

Tertiary coil 31 may be wounded around at least one of outer magnetic legs 34A and 34B and inner magnetic leg 32. Tertiary coil 31 may be connected to stabilizing circuit 56 controlling brightness of U-shaped discharge lamps 24 and 124. Tertiary coil 31 may be connected to protection circuit 58. Protection circuit 58 stops the operation of switching circuit 22 in an abnormal case of U-shaped discharge lamp 24 or 124.

Illuminating apparatus 2001 according to the embodiment includes two secondary coils 30 and 130 and two U-shaped discharge lamps 24 and 124 which are connected to secondary coils 30 and 130, respectively. The number of them may be three or more.

Figure 4:
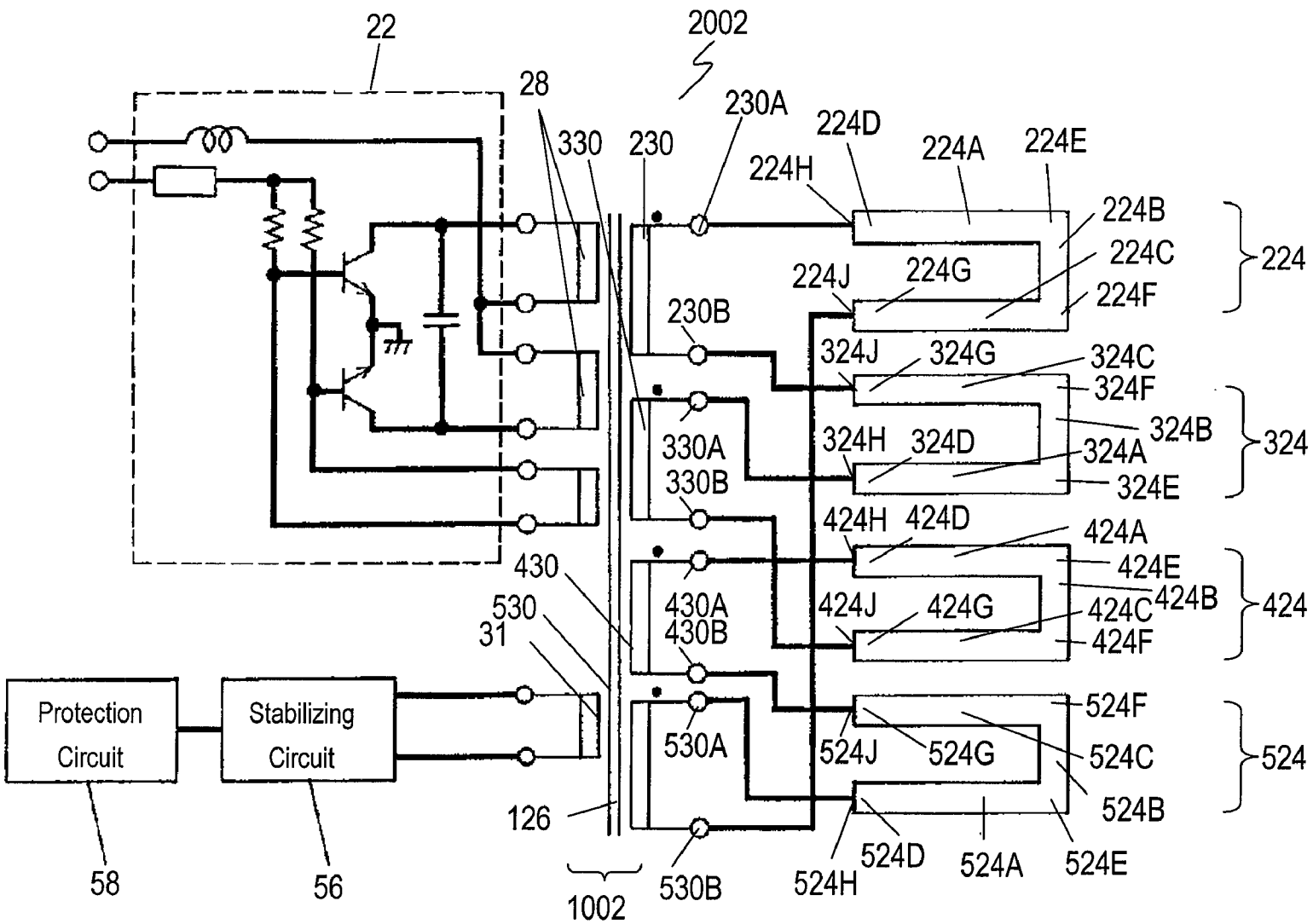
FIG. 4 is a circuit diagram of another illuminating apparatus according to the embodiment.

FIG. 4 is a circuit diagram of another illuminating apparatus 2001A according to the embodiment. Components identical to those of illuminating apparatus 2001 shown in FIG. 1A are denoted by the same reference numerals, and their description will be omitted. Illuminating apparatus 2001A includes four U-shaped discharge lamps 224, 324, 424, and 524, transformer 1002, and switching circuit 22 for inputting an AC voltage (a pulsating voltage) to primary coil 28 of transformer 1002. In the following explanation, the numbers of discharge lamps and secondary coils are not four, and generally, an illuminating apparatus including N pieces of discharge lamps and a transformer having N pieces of secondary coils will be explained. Here, N is an integer larger than 1.

Similarly to U-shaped discharge lamps 24 and 124 shown in FIG. 1A, U-shaped discharge lamp 224, the first discharge lamp, has a U-shape having two end portions 224D and 224G, and includes electrodes 224H and 224J provided at end portions 224D and 224G, respectively. U-shaped discharge lamp 324, the k-th discharge lamp ($1 \leqq k < N$), has a U-shape having two end portions 324D and 324G, and includes electrodes 324H and 324J provided at end portions 324D and 324G, respectively. U-shaped discharge lamp 424, the (k+1)-th discharge lamp, has a U-shape having two end portions 424D and 424G, and includes electrodes 424H and 424J provided at end portions 424D and 424G, respectively. U-shaped discharge lamp 524, the N-th discharge lamp, has a U-shape having two end portions 524D and 524G, and includes electrodes 524H and 524J provided at end portions 524D and 524G, respectively. U-shaped discharge lamps 224, 324, 424, and 524 are arranged, so that end portions 224G and 324G are adjacent to each other, end portions 324G and 424G are adjacent to each other, and end portions 424G and 524G are adjacent to each other.

Transformer 1002 includes primary coil 28, secondary coils 230, 330, 430, and 530, and tertiary coil 31 which are wounded around closed-magnetic-circuit core 126. Secondary coil 230, the first secondary coil, has ends 230A and 230B. Secondary coil 330, the k-th secondary coil, has ends 230A and 230B. Secondary coil 430, the (k+1)-th secondary coil, has ends 430A and 430B. Secondary coil 530, the N-th secondary coil, has ends 530A and 530B. Ends 230A, 330A, 430A, and 530A of secondary coils 230, 330, 430, and 530 have polarities identical to each other. When an AC voltage is applied to primary coil 28, terminals 230A, 330A, 430A, and 530A output AC voltages having phases identical to each other. Ends 230B, 330B, 430B, and 530B of secondary coils 230, 330, 430, and 530 have polarities identical to each other. When an AC voltage is applied to primary coil 28, terminals 230B, 330B, 430B, and 530B output AC voltages having phases an opposite to the phases of voltage output from ends 230A, 330A, 430A, and 530A. That is, ends 230B, 330B, 430B, and 530B output AC voltages having phases identical to each other.

End 230A of secondary coil 230 is connected to electrode 224H provided at end portion 224D of U-shaped discharge lamp 224. End 230B of secondary coil 230 is connected to electrode 324J provided at end portion 324G of U-shaped discharge lamp 324. End 330A of secondary coil 330, the k-th secondary coil, is connected to electrode 324H provided at end portion 324D of U-shaped discharge lamp 324, the k-th discharge lamp. End 330B of secondary coil 330 is connected to electrode 424J provided at end portion 424G of U-shaped discharge lamp 424. End 430A of secondary coil 430 is connected to electrode 424H provided at end portion 424D of U-shaped discharge lamp 424. End 430B of secondary coil 430 is connected to electrode 524J provided at end portion 524G of U-shaped discharge lamp 524. End 530A of secondary coil 530, the N-th secondary coil, is connected to electrode 524H provided at end portion 524D of U-shaped discharge lamp 524, the N-th discharge lamp. End 530B of secondary coil 530 is connected to electrode 224J provided at end portion 224G of U-shaped discharge lamp 224, the first discharge lamp. In this constitution, discharge lamps 224, 324, 424, 524, and secondary coils 230, 330, 430, and 530 are connected in series to each other, respectively.

Figure 5:
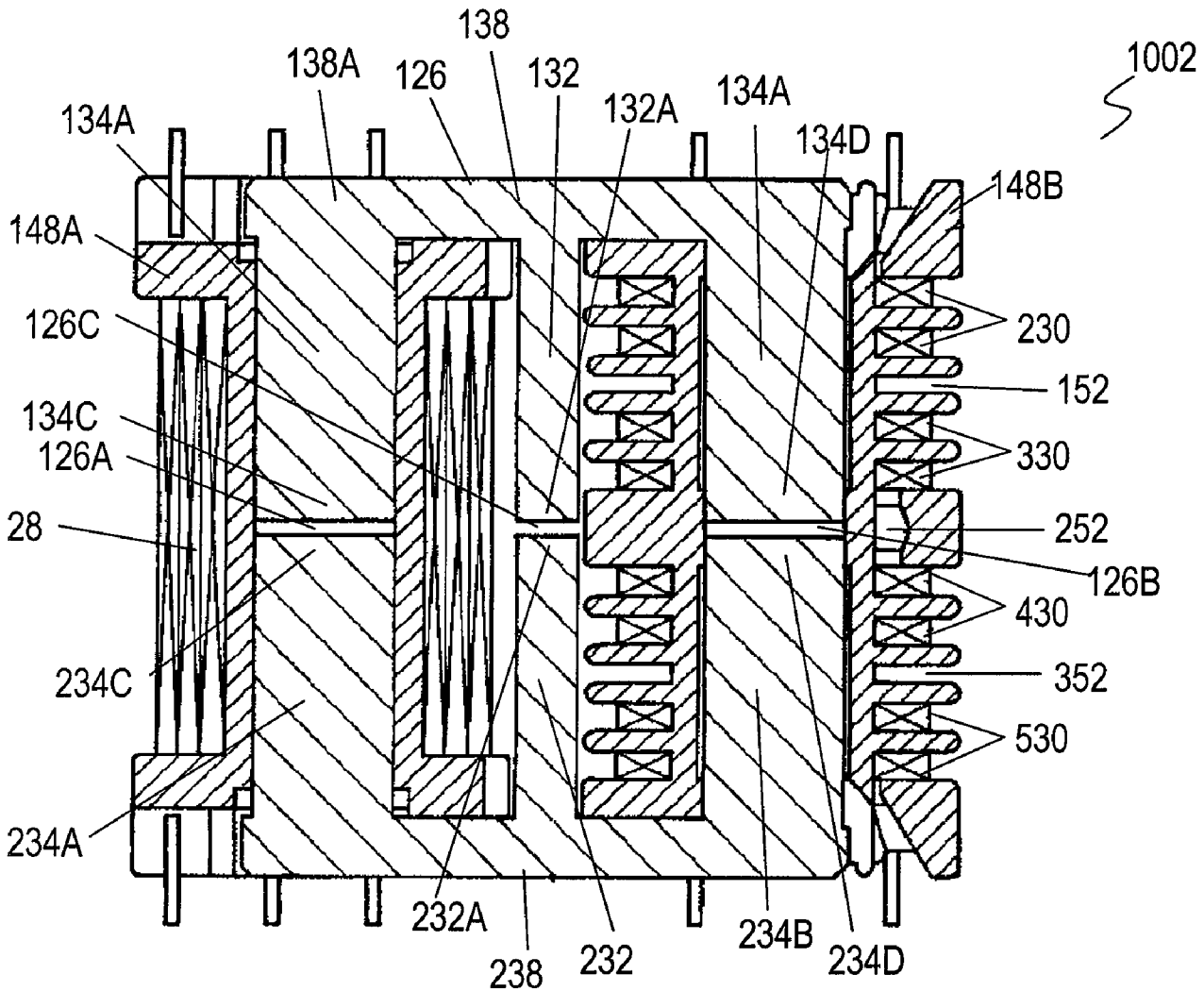
FIG. 5 is a cross sectional view of another transformer according to the embodiment.

FIG. 5 is a cross sectional view of transformer 1002. Closed-magnetic-circuit core 126 made of magnetic material includes E-shaped divided cores 138 and 238 having E-shapes. Similarly to E-shaped divided core 38 shown in FIG. 3, E-shaped divided core 138 includes outer magnetic legs 134A and 134B, inner magnetic leg 132, and coupling portion 138A having a bar shape, and these components are formed unitarily. Outer magnetic legs 134A and 134B are connected to respective ones of both ends of coupling portion 138A, respectively, and extend perpendicularly to coupling portion 138A. Inner magnetic leg 132 is located between outer magnetic legs 134A and 134B, and extends perpendicularly to coupling portion 138A from coupling portion 138A. E-shaped divided core 238 includes outer magnetic legs 234A and 234B, inner magnetic leg 232, and a coupling portion 238A having a bar shape, and these components are formed unitarily. Outer magnetic legs 234A and 234B are connected to respective ones of both ends of coupling portion 238A, and extend perpendicularly to coupling portion 238A. Inner magnetic leg 232 is located between outer magnetic legs 234A and 234B, and extends perpendicularly to coupling portion 238A from coupling portion 238A.

As shown in FIG. 5, in closed-magnetic-circuit core 126, tip 134C of outer magnetic leg 134A of E-shaped core 138 faces tip 234C of outer magnetic leg 234A of E-shaped divided core 238 across gap 126A. Tip 134D of outer magnetic leg 134B of E-shaped divided core 138 faces tip 234D of outer magnetic leg 234B of E-shaped divided core 238 across gap 126B. Tip 132A of inner magnetic leg 132 of E-shaped divided core 138 faces tip 232A of inner magnetic leg 232 of E-shaped divided core 238 across gap 126C. Primary coil 28 is wounded around outer magnetic legs 134A and 234A via bobbin 148A. Secondary coils 230, 330, 430, and 530 are wounded around outer magnetic legs 134B and 234B via bobbin 148B. Groove 152 is provided between secondary coils 230 and 330. Groove 252 is provided between secondary coils 330 and 430. Groove 352 is provided between secondary coils 430 and 530. The interval of gap 126C between inner magnetic legs 132 and 232 changes the amount of leakage magnetic flux.

In FIG. 5, E-shaped divided core 138 and 238 may not necessarily include inner magnetic legs 132 and 232, respectively. In this case, E-shaped divided core 138 has a U-shape having only coupling portion 138A and outer magnetic legs 134A and 134B extending perpendicularly from respective ones of both ends of coupling portion 138A. E-shaped divided core 238 has a U-shape having only coupling portion and outer magnetic legs 234A and 238B extending perpendicularly from respective ones of both ends of coupling portion 238A.

Figure 6:
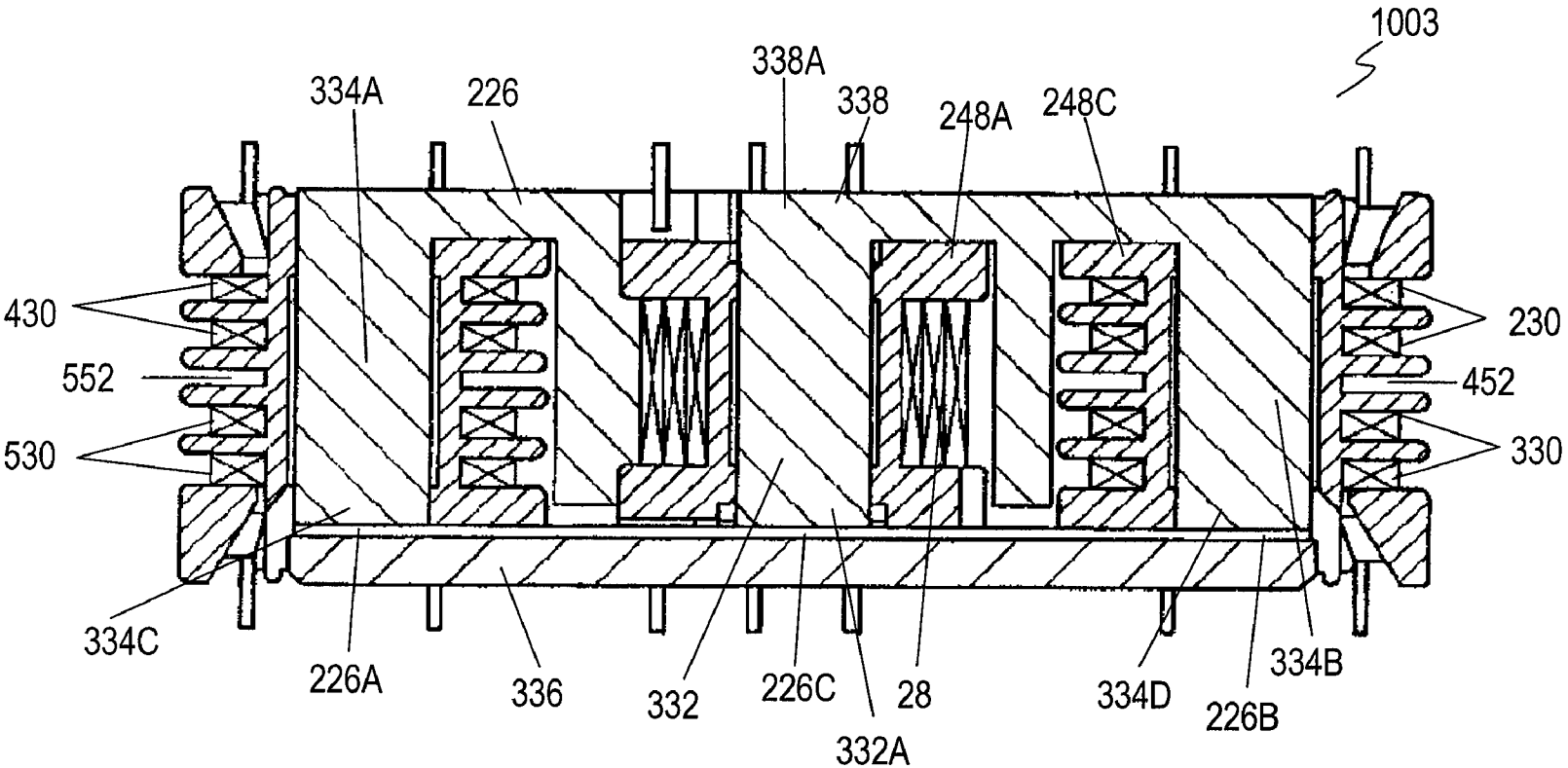
FIG. 6 is a cross sectional view of still another transformer according to the embodiment.

FIG. 6 is a cross sectional view of further transformer 1003 according to the embodiment. Transformer 1003 includes closed-magnetic-circuit core 226. Core 226 includes E-shaped divided core 338 having an E-shape and I-shaped divided core 336 having an I-shape. E-shaped divided core 338 includes outer magnetic legs 334A and 334B, inner magnetic leg 332, and coupling portion 338A having a bar shape, and these components are formed unitarily. Outer magnetic legs 334A and 334B extend perpendicularly from respective ones of both ends of coupling portion 338A. In core 226, gaps 226A and 226B are provided between outer magnetic legs 334A and 334B of E-shaped divided core 338 and I-shaped divided core 336, respectively. Gap 226C is provided between inner magnetic leg 332 and I-shaped divided core 336.

Primary coil 28 is wounded around inner magnetic leg 332 via bobbin 248A. Secondary coils 430 and 530 are wounded around outer magnetic leg 338A via bobbin 248B. Groove 552 is provided between secondary coils 430 and 530. Secondary coils 230 and 330 are wounded around outer magnetic leg 338B via bobbin 248C. Groove 452 is provided between secondary coils 230 and 330. Ends of secondary coils 230 and 330 adjacent to each other are arranged according to a specification of their polarities.

Tertiary coil 31 may be wounded around at least one of the outer magnetic legs and the inner magnetic leg of the closed-magnetic-circuit core. Tertiary coil 31 may be connected to stabilizing circuit 56 controlling brightness of the U-shaped discharge lamps.

Figure 7:
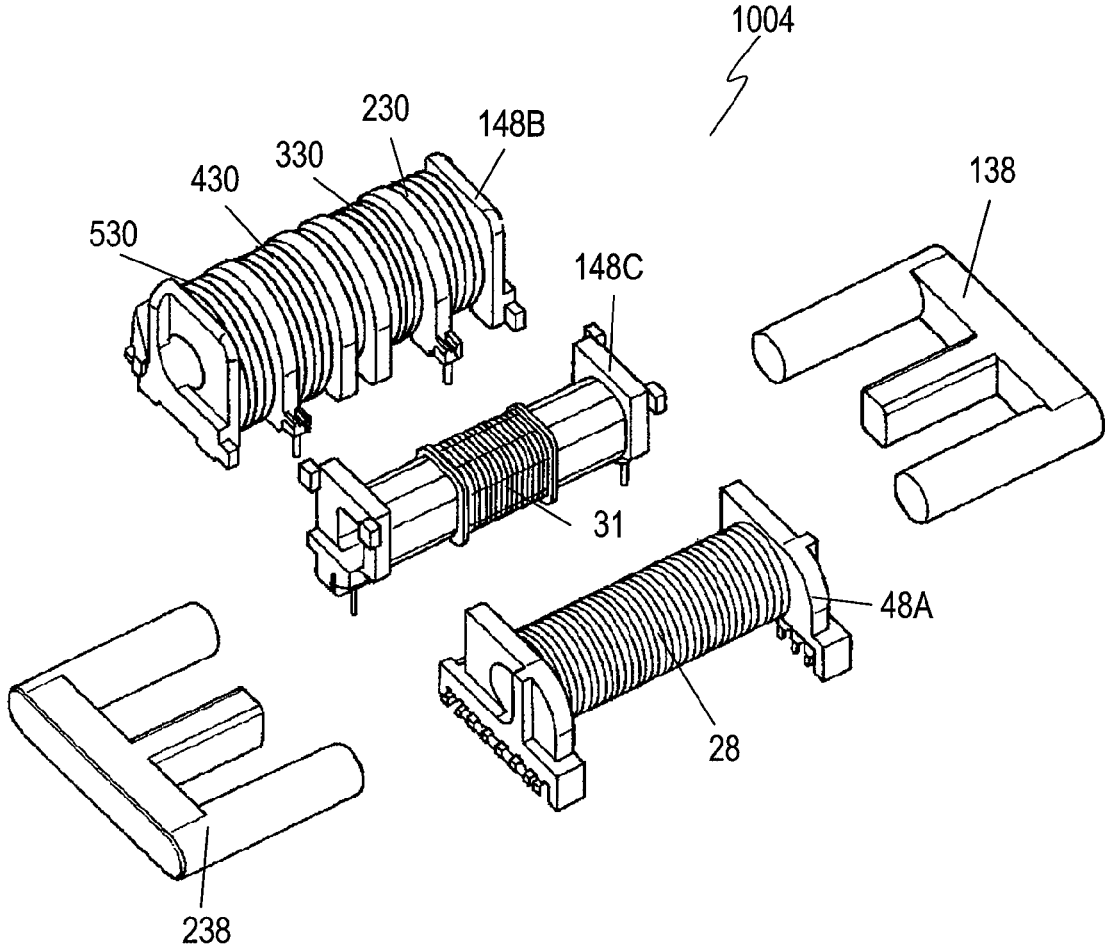
FIG. 7 is an exploded perspective view of still another transformer according to the embodiment.
Figure 8:
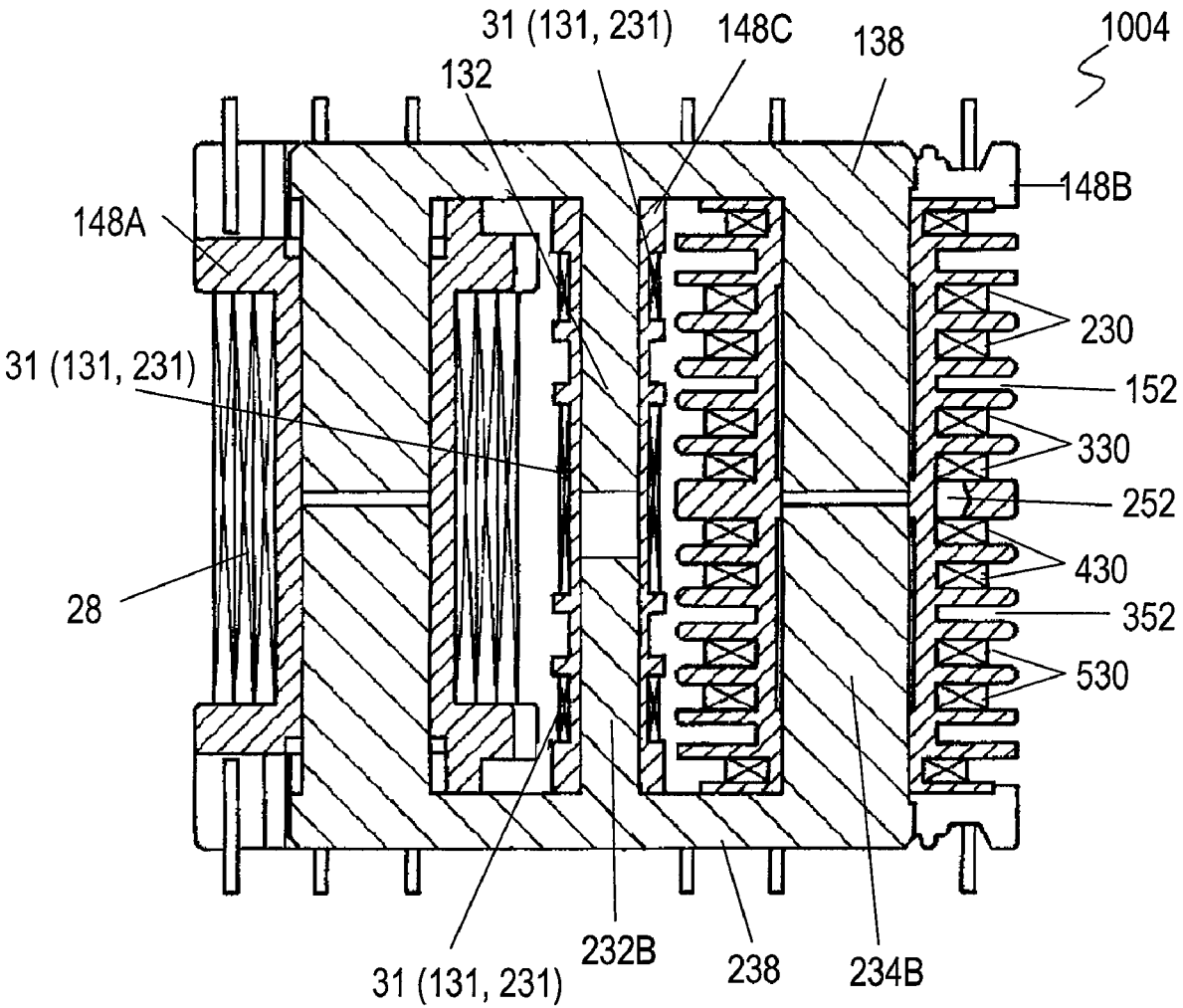
FIG. 8 is a cross sectional view of the transformer shown in FIG. 7.

FIGS. 7 and 8 are an exploded perspective view and a cross sectional view of further transformer 1004. In transformer 1004, tertiary coil 31 is wounded via bobbin 148C around inner magnetic legs 132 and 232 of transformer 1002 shown in FIG. 4. In divided core 238, inner magnetic leg 232B is shorter than outer magnetic legs 234A and 234B. Tertiary coil 31 is provided gap 126D between inner magnetic leg 132 and inner magnetic leg 232B.

Tertiary coil 31 may be connected to protection circuit 58 which can stop the operation of the switching circuit in an abnormal case of the U-shaped discharge lamps. Instead of tertiary coil 31, two tertiary coils 131 and 231 may be wounded around inner magnetic legs 132 and 232. The difference between voltages generated in tertiary coils 131 and 231 is detected to detect an abnormality of the U-shaped discharge lamps accurately.

Figure 9:
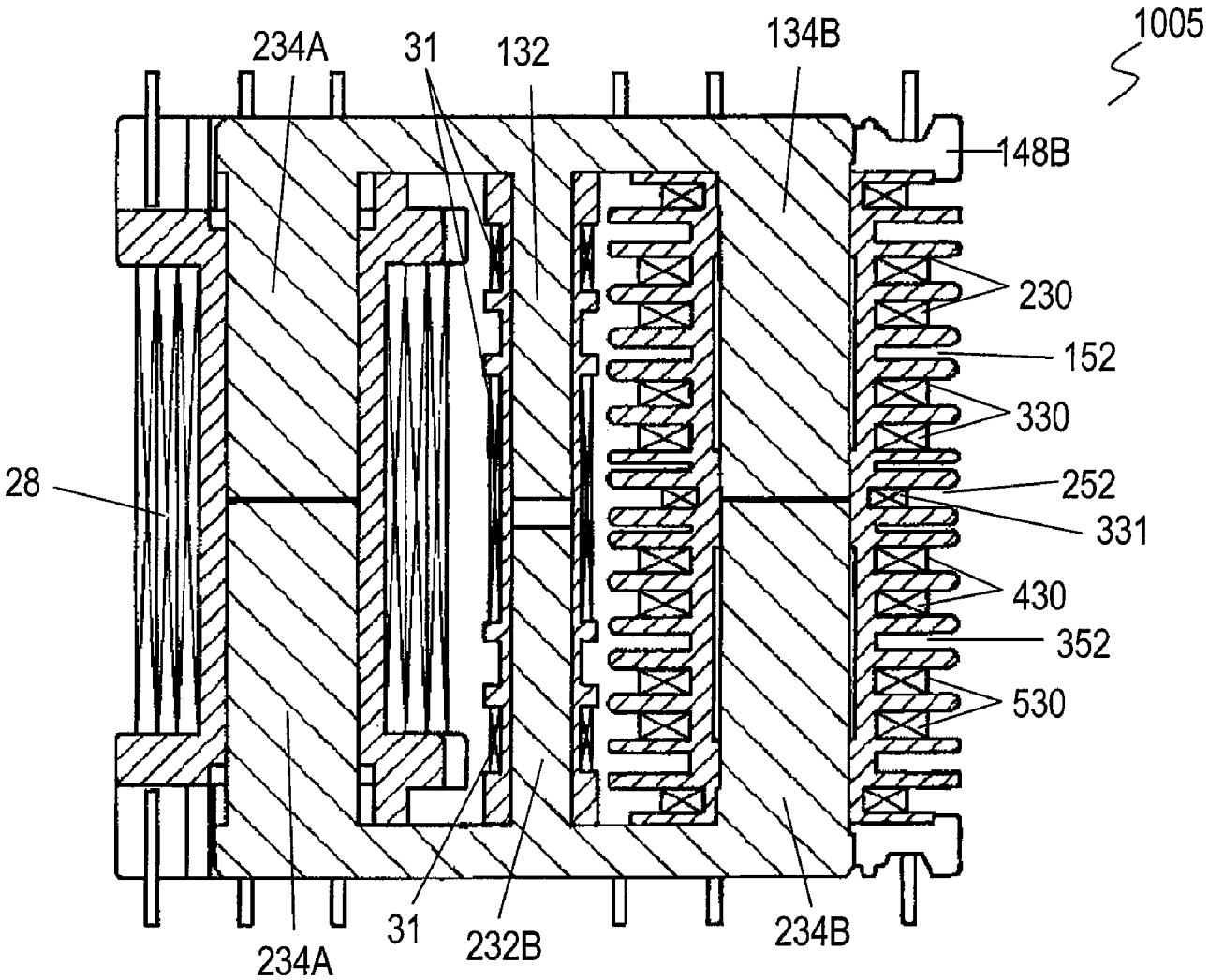
FIG. 9 is a cross sectional view of still another transformer according to the embodiment.

FIG. 9 is a cross sectional view of further transformer 1005 according to the embodiment. Transformer 1005 includes tertiary coil 331 is provided at the groove of transformer 1004 shown in FIGS. 7 and 8, namely, at the center between outer magnetic leg portions 134B and 234B. In this case, tertiary coil 331 is arranged at gap 126B between outer magnetic legs 134 and 234.

Figure 10:
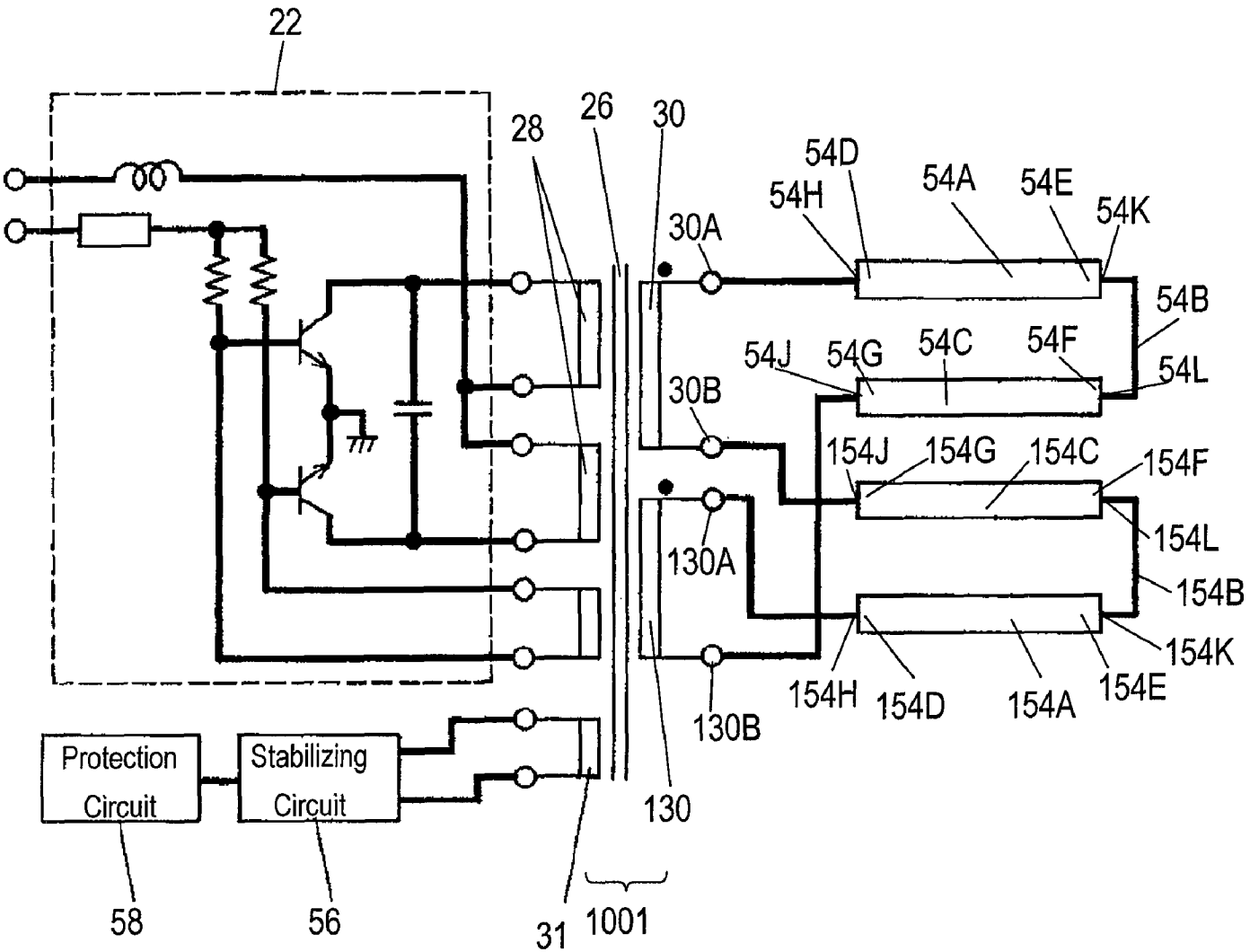
FIG. 10 is a circuit diagram of a further illuminating apparatus according to the embodiment.
Figure 11:
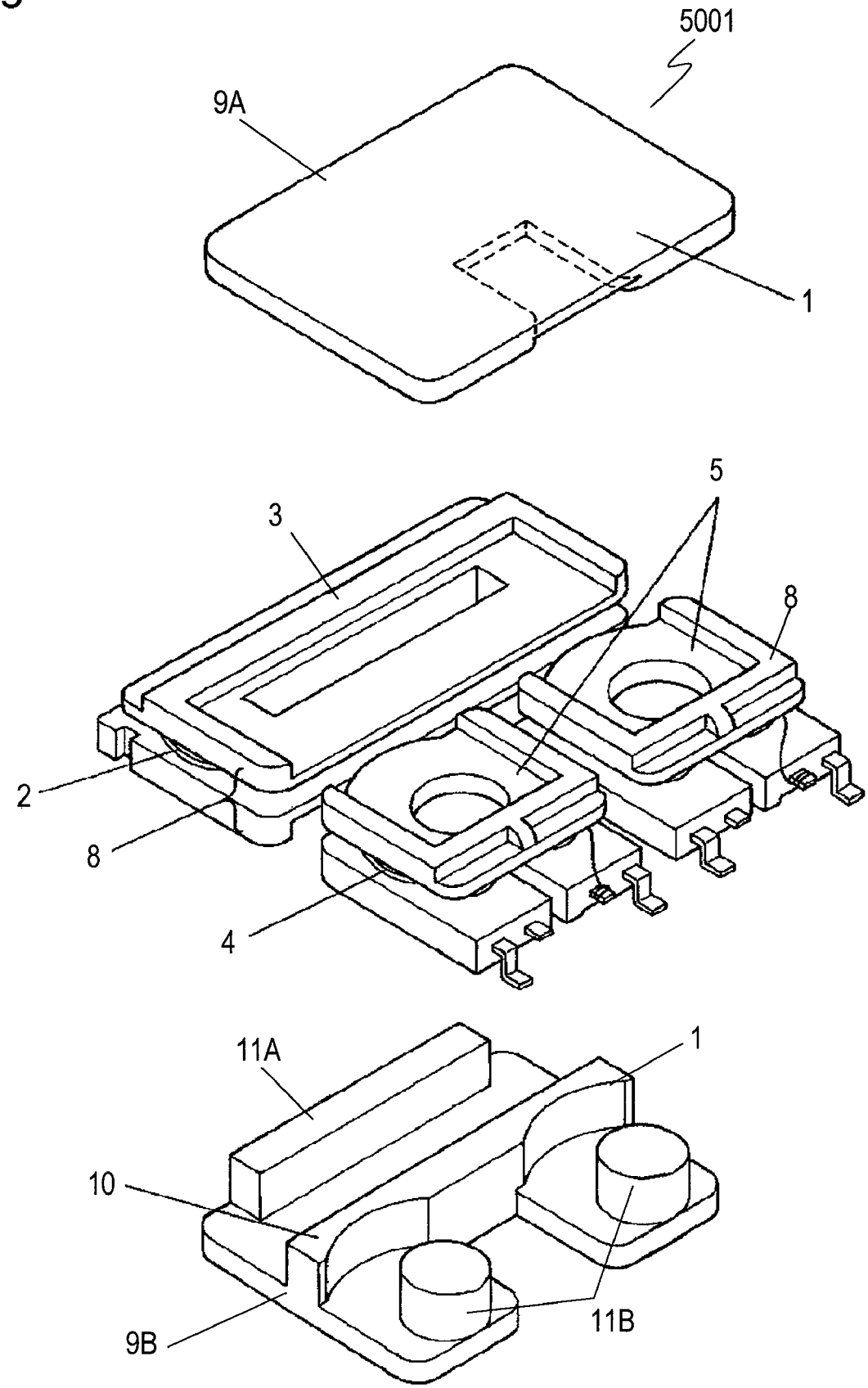
FIG. 11 is an exploded perspective view of a conventional transformer.
Figure 12:
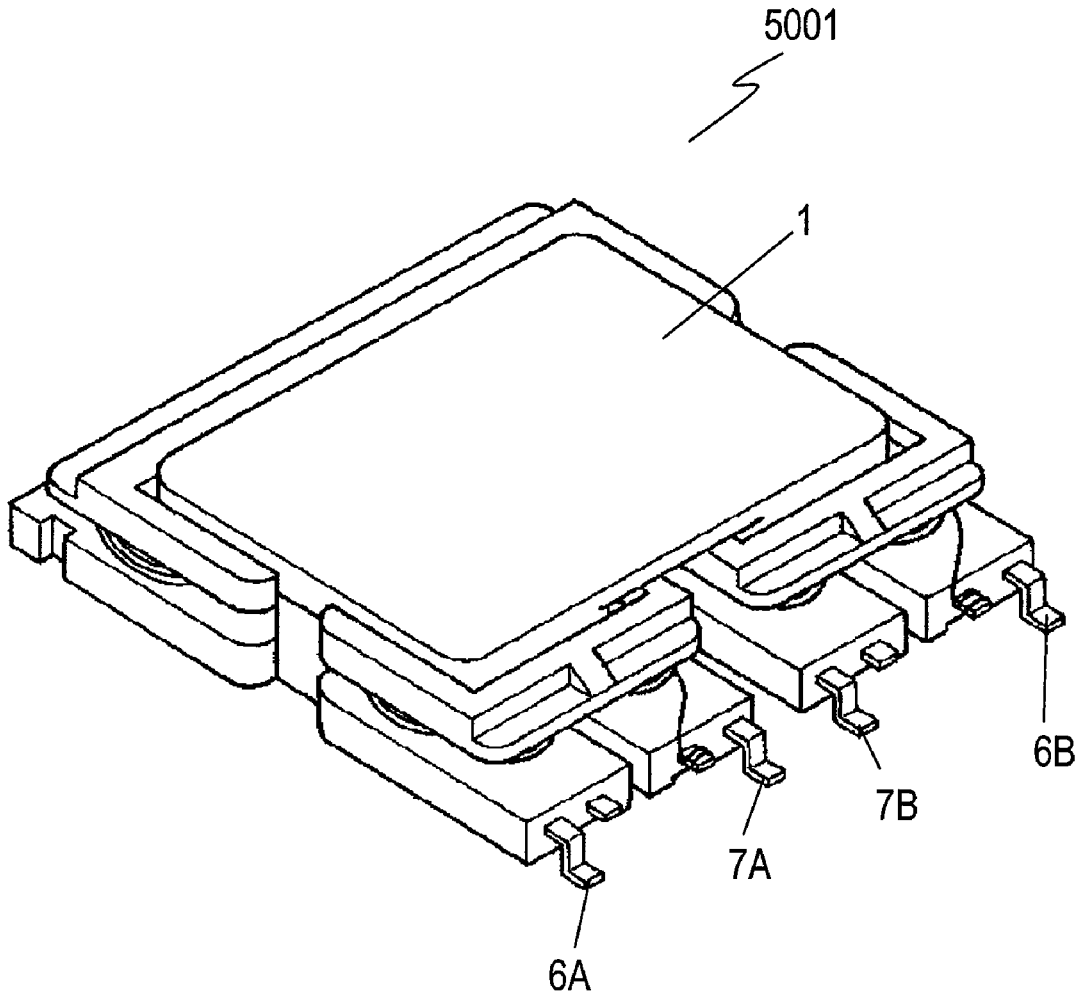
FIG. 12 is a perspective view of the conventional transformer.

FIG. 10 is a circuit diagram of further illuminating apparatus 2001B according to the embodiment. Illuminating apparatus 2001B includes two straight discharge lamps 54A and 54B instead of U-shaped discharge lamp 24 of illuminating apparatus 2001 shown in FIG. 1, and includes two straight discharge lamps 154A and 154B instead of U-shaped discharge lamp 124. Straight discharge lamps 54A, 54B, 154A, and 154B are arranged in parallel with each other.

Straight discharge lamp 54A has end portions 54D and 54E. Straight discharge lamps 54C has end portions 54G and 54F. Electrodes 54H and 54K are provided at end portions 54D and 54E of straight discharge lamp 54A, respectively. Electrodes 54J and 54L are provided at end portions 54G and 54F of straight discharge lamp 54C, respectively. Electrode 54K of straight discharge lamp 54A is connected to electrode 54L of straight discharge lamp 54C via connection wire 54B. As shown in FIGS. 1 and 10, straight discharge lamp 54A and straight discharge lamp 54C are connected in series with each other, thus virtually providing U-shaped discharge lamp 24. In this case, end portion 54D and electrode 54H of straight discharge lamp 54A function as end portion 24D and electrode 24H of U-shaped discharge lamp 24 shown in FIG. 1, respectively. End portion 54G and electrode 54J of straight discharge lamp 54C function as end portion 24G and electrode 24J of U-shaped discharge lamp 24 shown in FIG. 1, respectively.

Similarly, straight discharge lamp 154A has end portions 154D and 154E. Straight discharge lamp 154C has end portions 154G and 154F. Electrodes 154H and 154K are provided at end portions 154D and 154E of straight discharge lamp 154A, respectively. Electrodes 154J and 154L are provided at end portions 154G and 154F of straight discharge lamp 154C, respectively. Electrode 154K of straight discharge lamp 154A is connected to electrode 154L of straight discharge lamp 154C via connection wire 154B. As shown in FIGS. 1 10, straight discharge lamp 154A and straight discharge lamp 154C are connected in series with each other, virtually providing U-shaped discharge lamp 124. In this case, end portion 154D and electrode 154H of straight discharge lamp 54A function as end portion 124D and electrode 124H of U-shaped discharge lamp 124 shown in FIG. 1, respectively. End portion 154G and electrode 154J of straight discharge lamp 154C function as end portion 124G and electrode 124J of U-shaped discharge lamp 124 shown in FIG. 1, respectively.

INDUSTRIAL APPLICABILITY

A transformer and an illuminating apparatus according to the present invention reduce variation of lighting timings of discharge lamps, and provide an illuminating apparatus having small brightness variation, being useful for a display apparatus.

The invention claimed is:

1. A transformer used for an illuminating apparatus, comprising:

a closed-magnetic-circuit core;

a primary coil wounded around the closed-magnetic-circuit core; and a plurality of secondary coils wounded around the closed-magnetic-circuit core, the plurality of secondary coils including respective first ends and respective second ends, wherein the illuminating apparatus comprises a plurality of discharge lamps;

wherein the plurality of secondary coils includes a first secondary coil and a second secondary coil, a first end of the first secondary coil and a first end of the second secondary coil have polarities identical to each other; and a second end of the first secondary coil and a second end of the second secondary coil have polarities identical to each other; the plurality of discharge lamps includes a first discharge lamp and a second discharge lamp, the first discharge lamp having a first electrode and a second electrode, the second discharge lamp having a third electrode and a fourth electrode, the first end of the first secondary coil is connected to the first electrode of the first discharge lamp, the second end of the first secondary coil is connected to the third electrode of the second discharge lamp, the first end of the second secondary coil is connected to the fourth electrode of the second discharge lamp, and the second end of the second secondary coil is connected to the second electrode of the first discharge lamp.

2. The transformer according to claim 1, further comprising a tertiary coil wounded around the closed-magnetic-circuit core.

3. The transformer according to claim 1, wherein the closed-magnetic-circuit core includes a coupling portion, a first outer magnetic leg extending from the coupling portion, the primary coil being wounded around the first outer magnetic leg, and a second outer magnetic leg extending from the coupling portion, the plurality of secondary coils being wounded around the second outer magnetic leg.

4. The transformer according to claim 3, wherein the closed-magnetic-circuit core further includes an inner magnetic leg extending from the coupling portion, the inner magnetic leg being located between the first outer magnetic leg and the second outer magnetic leg.

5. The transformer according to claim 3, wherein the plurality of secondary coils are arranged at the second outer magnetic leg, such that the respective first ends of the plurality of secondary coils are adjacent to each other, and the respective first ends of the plurality of secondary coils have potentials identical to each other.

6. The transformer according to claim 1, wherein the closed magnetic circuit core includes a coupling portion;

a first outer magnetic leg extending from the coupling portion;

a second outer magnetic leg extending from the coupling portion; and an inner magnetic leg extending from the coupling portion and located between the first outer magnetic leg and the second outer magnetic leg, the primary core being wounded around the inner magnetic leg, and the plurality of the secondary coils are wounded around the first outer magnetic leg and the second outer magnetic leg.

7. An illuminating apparatus comprising:

a plurality of discharge lamps; and a transformer including a closed-magnetic-circuit core, a primary coil wounded around the closed-magnetic-circuit core, and a plurality of secondary coils wounded around the closed-magnetic-circuit core, the plurality of secondary coils including respective first ends and respective second ends, wherein the plurality of secondary coils includes a first secondary coil and a second secondary coil, a first end of the first secondary coil and a first end of the second secondary coil have polarities identical to each other; and a second end of the first secondary coil and a second end of the second secondary coil have polarities identical to each other; the plurality of discharge lamps includes a first discharge lamp and a second discharge lamp, the first discharge lamp having a first electrode and a second electrode, the second discharge lamp having a third electrode and a fourth electrode, the first end of the first secondary coil is connected to the first electrode of the first discharge lamp, the second end of the first secondary coil is connected to the third electrode of the second discharge lamp, the first end of the second secondary coil is connected to the fourth electrode of the second discharge lamp, and the second end of the second secondary coil is connected to the second electrode of the first discharge lamp.

8. The illuminating apparatus according to claim 7, further comprising a tertiary coil wounded around the closed-magnetic-circuit core.

9. The illuminating apparatus according to claim 7, wherein the closed-magnetic-circuit core of the transformer includes a coupling portion, a first outer magnetic leg extending from the coupling portion, the primary coil being wounded around the first outer magnetic leg, and a second outer magnetic leg extending from the coupling portion, the plurality of secondary coils being wounded around the second outer magnetic leg.

10. The illuminating apparatus according to claim 9, wherein the closed-magnetic-circuit core of the transformer further includes an inner magnetic leg extending from the coupling portion, the inner magnetic leg being located between the first outer magnetic leg and the second outer magnetic leg.

11. The illuminating apparatus according to claim 9, wherein the plurality of secondary coils are arranged at the second outer magnetic leg, such that the respective first ends of the plurality of secondary coils are adjacent to each other, and the respective first ends of the plurality of secondary coils have potentials identical to each other.

12. The illuminating apparatus according to claim 7, wherein the closed magnetic circuit core includes a coupling portion;

a first outer magnetic leg extending from the coupling portion;

a second outer magnetic leg extending from the coupling portion; and an inner magnetic leg extending from the coupling portion and located between the first outer magnetic leg and the second outer magnetic leg, the primary core being wounded around the inner magnetic leg, and the plurality of the secondary coils are wounded around the first outer magnetic leg and the second outer magnetic leg.

13. The illuminating apparatus according to claim 7, wherein the plurality of discharge lamps comprise U-shaped discharge lamp.

14. The illuminating apparatus according to claim 7, wherein the plurality of discharge lamps includes a first discharge lamp and a second discharge lamp, the first discharge lamp includes a first end portion having the first electrode provided at the first end portion, and a second end portion having the second electrode provided at the second end portion, the second discharge lamp includes a third end portion having the third electrode provided at the third end portion, and a fourth end portion having the fourth electrode provided at the fourth end portion, the third end portion of the second discharge lamp is adjacent to the first end portion of the first discharge lamp, and the third electrode of the second discharge lamp and the first electrode of the first discharge lamp have polarities identical to each other.

15. A display apparatus comprising:

an illuminating apparatus according to claim 7; and a display device illuminated by the plurality of discharge lamps.

16. A display apparatus comprising:

an illuminating apparatus according to claim 8; and a display device illuminated by the plurality of discharge lamps.

17. A display apparatus comprising:

an illuminating apparatus according to claim 9; and a display device illuminated by the plurality of discharge lamps.

18. A display apparatus comprising:

an illuminating apparatus according to claim 10; and a display device illuminated by the plurality of discharge lamps.

19. A display apparatus comprising:

an illuminating apparatus according to claim 11; and a display device illuminated by the plurality of discharge lamps.

20. A display apparatus comprising:

an illuminating apparatus according to claim 12; and a display device illuminated by the plurality of discharge lamps.

21. A display apparatus comprising:

an illuminating apparatus according to claim 13; and a display device illuminated by the plurality of discharge lamps.

22. A display apparatus comprising:

an illuminating apparatus according to claim 14; and a display device illuminated by the plurality of discharge lamps.

* * * * *